United States Patent [19]

Moen

[11] 3,994,256

[45] Nov. 30, 1976

[54] UNIVERSAL FLUID DISPENSER APPARATUS

[76] Inventor: Lenard E. Moen, 7914 Michigan, Whittier, Calif. 90602

[22] Filed: June 9, 1975

[21] Appl. No.: 584,908

Related U.S. Application Data

[62] Division of Ser. No. 366,629, June 4, 1973, abandoned.

[52] U.S. Cl. ..... 118/3; 118/411

[51] Int. Cl.[2] ..... B05C 5/02; B05C 11/10

[58] Field of Search ..... 118/2, 3, 410, 411, 118/DIG. 3, 4; 222/146 HZ

[56] References Cited

UNITED STATES PATENTS

| | | | |
|---|---|---|---|
| 2,859,727 | 11/1958 | Phin et al. | 118/3 |
| 3,088,433 | 5/1963 | Walter et al. | 118/411 X |
| 3,425,393 | 2/1969 | Shuh et al. | 118/2 |

*Primary Examiner*—Dorsey Newton
*Attorney, Agent, or Firm*—Frederick E. Mueller

[57] ABSTRACT

A holder for a pair of reversible fluid dispensers comprises a prismatic body that is symmetrical about three mutually perpendicular axes. A holder and pair of dispensers can thus be assembled to serve as a fluid dispensing assembly for either the left or right margins of sheet material passed adjacent thereto in a plane to intercept and actuate the dispenser nozzles. As embodied in a hot glue dispenser, the holder body includes two sets of fluid passages and of heating element and heat sensor and control mounting cavities that are symmetrically disposed about the three axes. Each multiple dispenser assembly is supported by a bracket assembly that incorporates a means to adjust the dispenser assembly angularly relative to the direction of the materials being passed through the machine whereby to vary, as desired, the spacing between the pair of applicator nozzles. As embodied in a hot glue dispensing apparatus, each dispenser preferably is of the type having an actuator barrel mounted for pivotal movement about a single axis that is oriented normal to the direction of passage of the sheet material engaging the nozzle of the actuator barrel. The actuator barrel, in turn, is mounted in a retainer that is angularly adjustable relative to its supporting body to maintain this orientation of the pivot axis relative to the flow direction of the material for different angular positions of the dispenser body. The bracket assembly also has a staggered pair of support shoes positioned for contact with the underside of the sheet material being handled, the pair of support shoes being adjustable, in unison, longitudinally relative to the pair of dispenser nozzles. With this arrangement, each support shoe can be adjusted to the desired offset position relative to the dispenser nozzle associated therewith in order to permit a trailing end portion of a section of sheet material to wipe against an actuator nozzle with insufficient force to maintain the nozzle in an open condition.

7 Claims, 9 Drawing Figures

Fig. 1
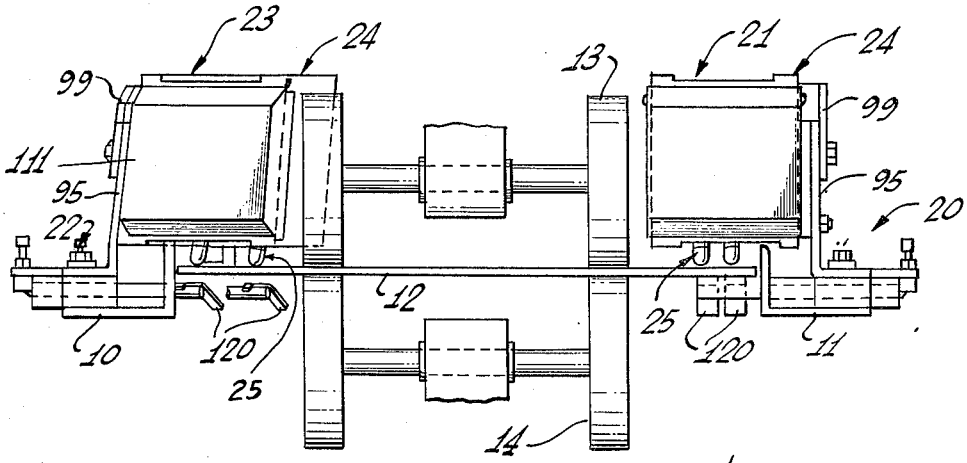
Fig. 2
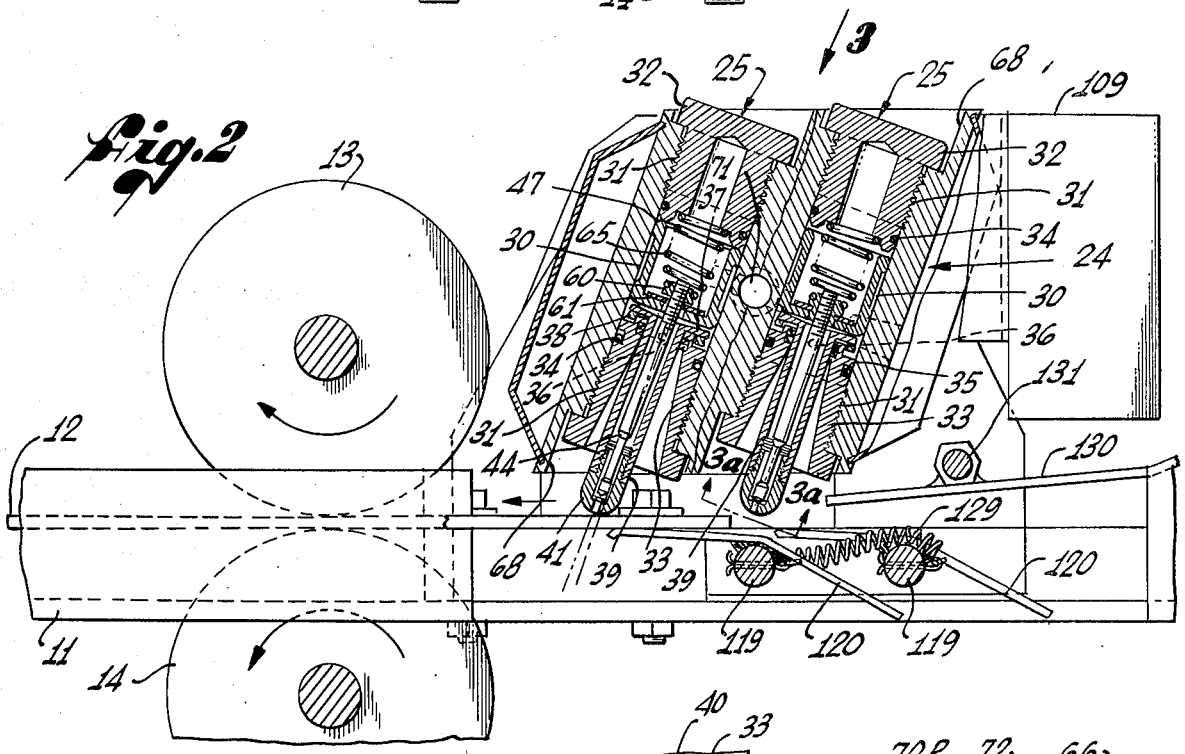
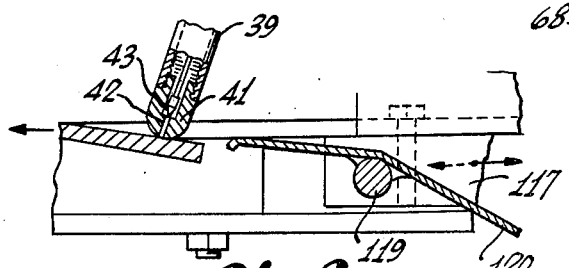
Fig. 2a
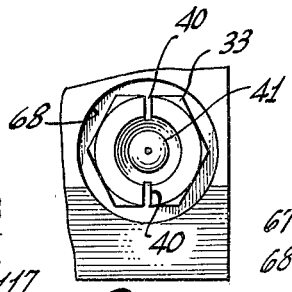
Fig. 3a
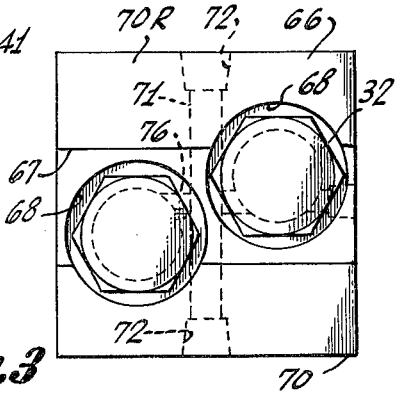
Fig. 3

UNIVERSAL FLUID DISPENSER APPARATUS

This application is a division of pending prior application Ser. No. 366,629 filed on June 4, 1973 now abandoned.

BACKGROUND OF THE INVENTION

The present invention relates generally to apparatus for applying a plurality of streams of a fluid to one surface of a sheet material passing adjacent thereto through a predetermined plane. More specifically, the invention relates to the application of hot or cold liquid glues to opposite margins of discrete sections of sheet material, as in box making. As the invention appears to have its greatest utility in the box making art and, especially, in the application of hot glues to box blanks, it will be specifically described with reference thereto by way of illustration, but not by way of limitation.

In certain types of box making machines, e.g., Bliss box machines, a plurality of hot or cold glue dispensers are provided at each side of the machine for applying a plurality of stripes of glue along the opposite margins of the box blank. Heretofore, it has been the practice to provide a separate mounting bracket for each dispenser so that each dispenser can be fixed in an adjusted position not only relative to the adjacent edge of the box blank but, also, with respect to the companion dispenser or dispensers on the same side of the machine. Accordingly, the set-up process has been time consuming and, in the case of hot glue dispensers, separate non-interchangable left and right side heated body dispensers have been employed.

SUMMARY OF THE INVENTION

The dispenser apparatus includes a bracket assembly by means of which the device can be secured to a box making machine, for example, with the dispenser nozzles disposed in a plane to be intercepted by the box blanks proceeding through the machine. A dispenser holder, comprising a solid prismatic body, is mounted on the bracket means so as to be pivotal between a raised inspection position and a lowered operative dispensing position. The prismatic body is formed with a parallel pair of through bores providing chambers to house the internal parts of the pair of dispenser mechanisms. The arrangement is such that each assembly of dispenser internal parts can be assembled in its bore in either of two 180° oppositely oriented positions relative to the prismatic body, whereby the exit orifices of the pair of dispenser nozzles can be oriented to either of two opposite sides of the body.

The body is formed with a symmetrical pair of glue conduit means, either one of which may be plugged while the other is hooked up in communication with a source of hot glue under pressure, depending on whether the body is to be used as a left-hand or right-hand glue dispenser apparatus. For the same reason, the body is also formed with two sets of cavities for the reception of a heater element and heater control and sensing elements, one set of which may be plugged while the other receives these elements which, in turn, are interconnected to a control system.

The bracket assembly, and that portion of the box making machine to which it is interconnected, are adapted to provide for angular adjustment of the dispenser body relative to the axis or direction of travel of the box blanks being processed. Accordingly, as the pair of applicators in the body are mounted in offset relationship, the lateral spacing therebetween can be adjusted, as desired, in order to achieve a desired spacing between beads of glue extruded onto the surfaces of the box blanks.

The bracket assembly also serves as a support for a pair of box blank support shoes, each of which is operatively associated with a nozzle of one of the glue applicators and with a deflection shoe affixed to the upstream side of the assembly. The deflection shoe bears against the upper surface of the box blank, while the support shoes engage the opposite side of the box blank to constrain the box blank to movement through a plane in which it intercepts the applicators to open the glue orifices thereof for depositing beads of glue on a surface of the box blanks. In order to accomodate different thicknesses of sheet material each of the support shoes is adjustable relative to the applicator nozzles.

BRIEF DESCRIPTION OF THE DRAWINGS

FIG. 1 is a somewhat schematic front-end elevational view of a box-making machine incorporating the invention.

FIG. 2 is a partial side elevation view, on a larger scale, partly in section, of the fluid dispenser apparatus.

FIG. 2*a* is a partial elevational view, similar to FIG. 2, showing another adjusted position of one of the support shoes relative to its associated applicator nozzle.

FIG. 3 is a plan view of one end face of the prismatic dispenser body, taken in the direction of the arrow 3 of FIG. 2.

FIG. 3*a* is a partial end view, taken on the line 3*a*—3*a* of FIG. 2.

DESCRIPTION OF THE PREFERRED EMBODIMENT

Figure 4:
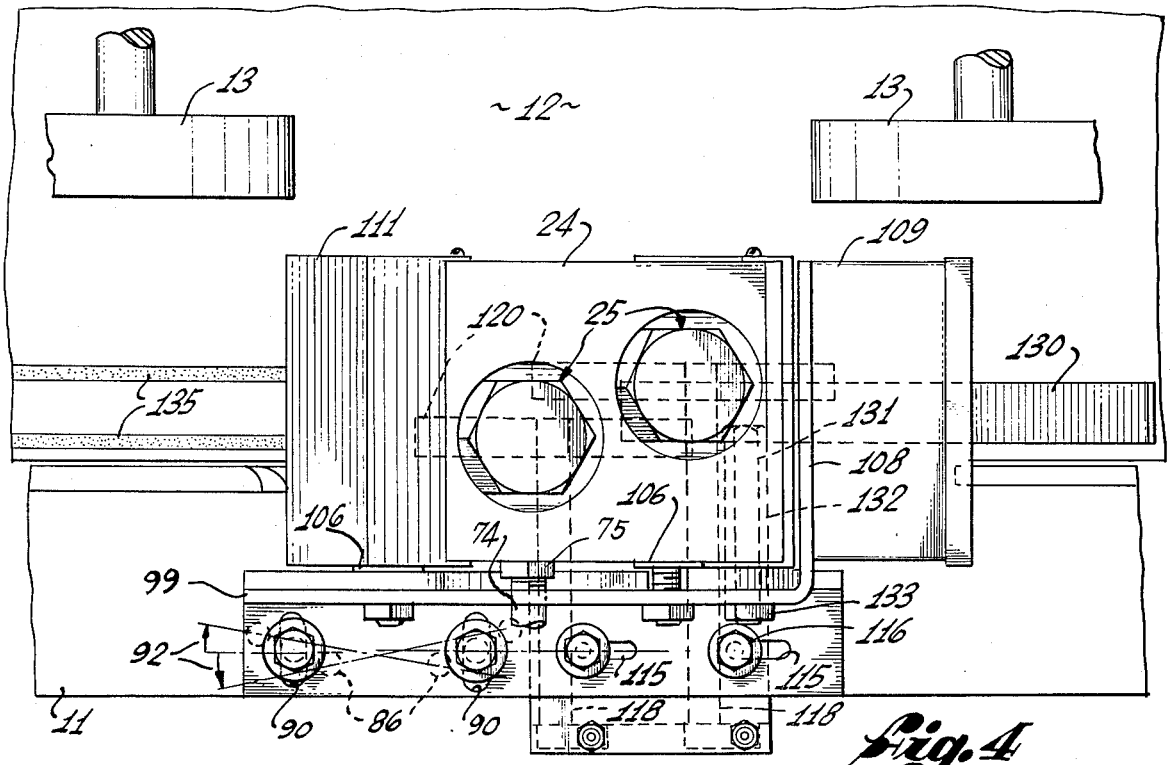
FIG. 4 is a partial top plan view of the dispenser apparatus of FIG. 2.

FIG. 1 schematically represents a box-making machine equipped with dispenser apparatus of this invention. While not illustrated, it is to be understood that the machine has the usual framework including a pair of rigidly supported angle-iron guide members 10 and 11 that are laterally adjustable to accommodate different widths of box blanks 12 to be processed by the machine. The vertically upstanding flanges of the guides 10 and 11 serve as guides for the opposite edges of each box blank. In order to feed the blanks 12 through the machine it may be equipped, for example, with sets of rollers 13 and 14 engagable with upper and lower sides, respectively, of each box blank 12, it being further understood that the sets of rollers 13 and 14 are provided at spaced longitudinal intervals on the machine framework.

In order to apply cold or hot glue to the opposite side margins of each box blank 12, a glue dispensing apparatus is disposed on each of the two sides of the machine. Thus, referring to the right-hand side of FIG. 1, a bracket assembly 20 is secured to the upper face of the horizontal flange of the guide member 11, in order to support a dispenser assembly 21 over the corresponding margin of a box blank 12. Similarly, on the opposite side of the machine there is a bracket assembly 22 secured to the horizontal flange of the guide member 10 in order to support a dispenser assembly 23 over the corresponding margin of a box blank 12. Both of the dispenser assemblies 21 and 23 incorporate identical dispenser bodies 24 and each body 24 mounts an identical pair of glue guns, generally indicated by the numeral 25. Thus, both the left and right-hand glue dispenser assemblies for the machine illustrated in FIG. 1 are made up of identical components to eliminate the necessity of manufacturing and inventorying different parts for left and right-hand applicators.

Figure 5:
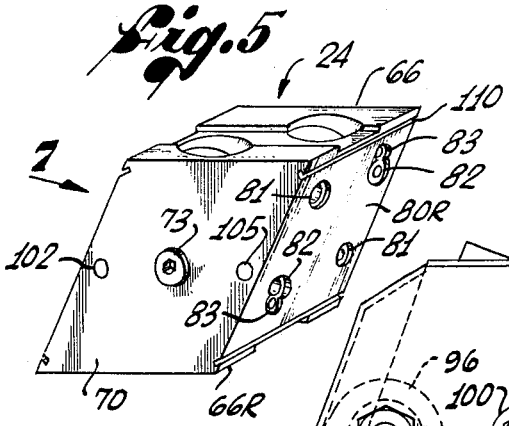
FIG. 5 is a perspective view of the dispenser body.

More particularly, the dispenser body 24 is an oblique prism whose overall surface configuration is best seen in the perspective view of FIG. 5. From an examination of FIGS. 5 and 7 it will be seen that the prism comprises three sets of parallel plane faces and that each face of a given pair has a surface configuration which is a mirror-image of the other surface of the pair. In the case of the illustrated hot glue applicator, the dispenser body 24 preferably is made of a solid block of aluminum adapted to serve as a heat sink, whereby to maintain the hot glue that is delivered therethrough at a desired constant elevated temperature.

Referring to FIG. 2, the body 24 is formed with a parallel pair of identical through-bores 30 for mounting an identical pair of glue gun assemblies 25. As best seen in FIGS. 3 and 5, the bores 30 are arranged in laterally offset or staggered tandem relationship in order to accommodate the pair of assemblies 25 within a minimum volume size of the prismatic body 24.

Each of the gun assemblies 25 is of the type disclosed in my application Ser. No. 357,501, filed May 4, 1973, issued as U.S. Pat. No. 3,854,631 on Dec. 17, 1974, which is hereby incorporated by reference thereto as though fully set forth herein at this point.

In order to mount a dispenser assembly 25, each of the bores 30 at its opposite ends is formed with identical sets of internal threads 31. Each dispenser assembly 25 includes a flow adjusting plug 32 and an actuator retainer 33, each being formed with an external section that is threaded for engagement with either of the sets of threads 31 at opposite ends of the bore 30. In order to provide a fluid seal, each of the parts 32 and 33 is adapted to mount an appropriate O-ring seal 34.

At its inner end, the retainer 33 is formed with an annular shoulder 35 to which a diametrically opposite coaxially aligned pair of pivot pins, indicated at 36, are secured in a manner to protrude from the radial surface of the shoulder. The pair of pins 36 rockably support a wear ring 37 which, in turn, acts as a seat for a radially outwardly extending flange 38 that is integrally formed on the inner end of a tubular actuator barrel 39. As is indicated in FIG. 2, the arrangement is such that the pivot axis defined by the pins 36 is at 90°, or normal, to the direction of flow of the box blanks 12 through the machine. In this connection, it will be observed that the retainer 33 is formed at its outer end with an enlarged head having wrench flats by means of which the retainer may be adjusted axially and angularly relative to the body 24. As is shown in FIG. 3*a*, the external face of the head of the retainer 33 is formed with a diametrically opposite, aligned pair of indicator marks or graduations 40 by means of which the desired relationship of the pivot axis defined by the pins 36 and the direction of flow of the work may be adjusted.

The lower end of the actuator barrel 39 is provided with a nozzle 41 having an outlet orifice 42. Within the nozzle 41 there is a valve member 43 that is normally closed by the head of a valve stem 44 whose rear end is operatively interconnected to a spool 47 that is axially slidably mounted in its bore 30 for reciprocation within the limits imposed by the opposing end faces of the retainer 33 and the flow adjusting plug 32. Thus, the rear end of the valve stem mounts a lock nut 60 which bears against a concentric washer 61 that, in turn, bears against the inside of a forward end wall of the spool. A spring 65, biased between the plug 32 and the nut 60, normally maintains the valve in the position indicated in the right hand one of the dispensers 25 of FIG. 2, whereby the orifice of the nozzle is closed. Upon the actuator barrel 39 being deflected by the leading edge of a box blank 12, the parts are cammed to the open position of the valve illustrated in the left hand one of the dispensers 25 in FIG. 2.

As will now be apparent, each gun assembly 25 may be mounted in one of the through bores 30 in either the position shown in FIG. 2 or in a position which is an 180° reversal, relative to the body 24, from that illustrated. Thus, in the relative relationship of the parts shown in FIG. 2 the assembly constitutes the dispenser assembly 21 illustrated on the right-hand side of FIG. 1. Now, if it be assumed that the dispenser assemblies 25 are reversed 180° relative to the body 24 and that the resulting dispenser assembly is inverted 180°, the result is the dispenser assembly 23, on the left-hand side of FIG. 1. In either case, corresponding ones of the pairs of heater mounting cavities and heater sensor and control cavities are plugged, as are one of the fluid conduit means, depending upon whether the particular assembly is the left-hand or right-hand dispenser assembly.

The dispenser body 24 has a parallel pair of opposite side faces 66 and 66R which are intersected by the pair of through bores 30. FIG. 3 is a plan view of the face 66 and it will now be understood that the opposite face 66R is a mirror image of the face 66. Thus, each face is formed with a transverse groove 67 receiving either the enlarged heads of a pair of the flow adjusting plugs 32 or the enlarged heads of a pair of the actuator retainers 33. As is shown in FIG. 2, the opposite ends of each of the through bores 30 are counterbored as indicated at 68 to receive the head of the threaded member 32 or 33.

Figure 7:
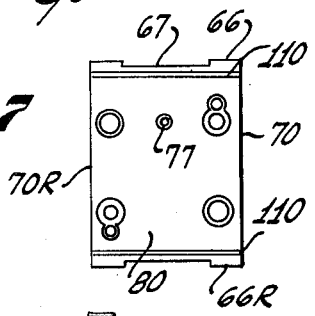
FIG. 7 is an end view of one face of the applicator body, taken in the direction of the directional arrow 7 of FIG. 5.
Figure 6:
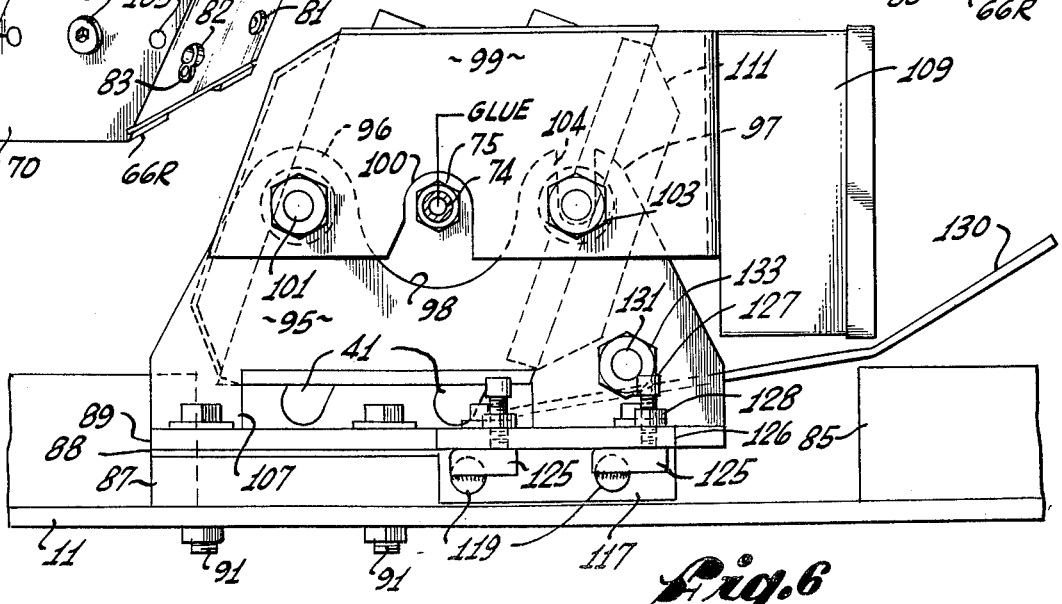
FIG. 6 is an elevational view of the dispenser apparatus of FIG. 2.

The dispenser body 24 may be interconnected to a source of glue through either of a pair of opposite sides 70 and 70R, which are mirror images of one another and disposed normally to the planes of the parallel pair of faces 66 and 66R. Thus, as shown in FIG. 3, the opposite faces 70 and 70R are interconnected by a through bore 71, the opposite ends of which are counterbored and tapped as indicated at 72. One of the ends of the bore 71 may be closed by a threaded plug 73, such as is shown in FIG. 5. The other tapped end of the bore 71 receives a coupling 75 such as is indicated in FIG. 6 and which, in turn, may be interconnected to a hose 74, shown in FIG. 4, communicating with a source of hot glue under pressure. As is shown in FIG. 3, the through bore 71 passes between the bores 30 for the assemblies 25 and is communicated therewith by means of a bore 76 extending between the bore 30 and having its non-blind and closed by a plug 77 (FIG. 7).

The remaining pair of parallel faces of the body 24, indicated at 80 and 80R, are provided with cavities for mounting pairs of heating elements, temperature sensors and temperature control elements, the cavities of which make surface patterns of the two parallel opposite faces which are mirror images of one another. Thus, as is shown in FIG. 6, the face 80R has a pair of diagonally opposite cavities 81, adapted for the reception of resistance heating elements whereby to elevate the temperature of the body 24 to a desired degree. At the other diagonally opposite corner areas of the face 80R there are adjacent pairs of cavities 82 and 83, one adapted for the reception of a temperature sensing element and the other adapted for the reception of a thermocouple or like means for controlling the temperature of the dispenser body.

Each of the dispenser assemblies 21 and 23 is held in operative positions by means of the bracket assembly 20 or bracket assembly 22, respectively. As these bracket assemblies are mirror images of one another only one of them will be described in detail.

As is shown in FIG. 6, the angle iron guide member 11 is formed with a window 85 in its upstanding flange in the region where it is desired to mount the dispenser assembly 21, for example. As is shown in FIG. 4, the horizontal flange of the guide member 11 is formed with a plurality of sets of bolt holes 86 arranged on an arcuate pattern. The bracket assembly 20 includes a mounting block 87 on top of which a shim 88 is disposed beneath the horizontal flange of an angle member 89 formed with a transverse pair of slots 90. The block 87 and shim 88 are formed with a pair of holes to receive a pair of nut and bolt fastening means 91 by means of which the bracket assembly 20 can be rigidly secured, through lateral adjustment slots 90, to a selected pair of the bolt holes 86 of the guide member 11. As is indicated in FIG. 4 by the arcs 92, the angular position of the mounting block 87 and, consequently, of the entire bracket assembly and the dispenser assembly supported thereon, relative to the direction of travel of the box blanks through the machine, can be adjusted as desired.

Angle member 89 is formed with an upstanding flange 95 to which the dispenser assembly 21 is interconnected for movement between the operative position shown in FIG. 6 and an upwardly tilted inspection position. The flange 95 includes a pair of upwardly projecting ears 96 and 97 that are separated by a concave window notch 98 that registers with the location of the connection of the glue supply line 74 to adjacent face 70 of dispenser body 24. An L-shaped support member 99 is similarly formed with a window notch 100, in a lower edge of a long leg thereof, also in registration with the point of connection of the glue supply to the dispenser body.

A pivot bolt assembly 101 passes through aligned bores in the ear 96 and the forward end of the support member 99, having its inner end threadedly engaged with a tapped blind hole 102 formed in the face 70 of the dispenser body 24. Another attachment bolt assembly 103 extends through a bore formed through the support member 99 and through an open ended slot 104 formed in the ear 97 to have its threaded inner end connected to another tapped bore 105 that is also formed in the face 70 of the dispenser body 24. It will be understood that as the face 70R of the body 24 is a mirror image of the face 70 that it also is formed with the tapped bores 102 and 105. In order to minimize heat conduction between the heated body 24 and the bracket assembly 20, thermally insulating washers 106 are interposed between the inside face of the support member 99 and the face 70 of the body 24, as indicated in FIG. 4.

It will now be seen that with the foregoing arrangement when the nut of the bolt assembly 103 is loosened the dispenser assembly 21 and the support member 99 associated therewith may be pivoted upwardly about the axis of the pivot bolt assembly 101 whereby to expose the normally under face of the dispenser assembly to view for inspection and maintenance of the gun assemblies 25 at their outlet ends and, also, for the purpose of making any necessary adjustments in the pivot axes of the dispenser actuator barrels by reference to the indicator marks 40. In order to secure the dispenser assembly in operative position, the device is thereafter pivoted downwardly and the nut of the bolt assembly 103 tightened up to clamp the assembly in position. A window 107 in the flange 95 of angle member 89 permits viewing of the nozzles 41 for adjusting the support shoes relative thereto, as will later appear.

Referring to FIG. 4, it will be seen that the support member 99 is formed with a rear flange 108 to whose rear face a control box 109 is secured by means of screw fasteners or the like. While not illustrated, it will be understood that the control box 109 holds electrical and other elements operatively associated with the heating elements and temperature control elements mounted in the pairs of cavities 81, 82 and 83 of the adjacent face 80 or 80R of the dispenser body 24. In order to protect the interconnections between the control elements of the box 109 and the corresponding elements mounted in the adjacent face of the body 24, mirror image faces 80 and 80R of the body are formed with a parallel pair of transverse slots 110 for snap engagement with opposite ends of a sheet metal cover member 111, at least one side of which is open in order to permit the passage of the interconnecting elements.

The bracket assembly 20 also supports a pair of support shoes for engagement with the underside of box blanks passing thereover in a manner for adjustment of the shoes relative to the dispenser nozzles with which they are operatively associated. For this purpose, the horizontal flange of the angle member 89 is formed with an aligned pair of longitudinally extending slots 115 to receive a pair of bolt fasteners 116 interconnected to a support shoe mount 117 carried beneath the member 89 by pair of fasteners 116. As will be apparent, mounting block 117 can be shifted longitudinally relative to the member 89 and thereafter clamped to a desired adjusted position. The mounting block 117 is provided with a parallel pair of transverse bores 118 in order to journal a pair of rock shafts 119 having inner ends terminating adjacent to the location of the pair of applicator nozzles. As is seen in FIG. 2, the inner ends of the pair of rock shafts 119 each has an angularly shaped support shoe 120 rigidly affixed thereto and each of these support shoes has a forwardly projecting free end in proximity to one of the pair of dispenser nozzles. As is shown in FIG. 4, the support shoes 120 are arranged in the same staggered tandem relationship as are the dispenser assemblies 25.

As will now be apparent, the support shoes 120 can be adjusted in unison to achieve a desired longitudinal gap between the free end of each shoe and its associated dispenser nozzle by loosening the nuts of the fastener means 116 in order to shift the mounting block 117 relative to the angle bracket 89. In addition, each of the support shoes 120 is individually adjustable to vary the vertical gap between its forward free end and its associated dispenser nozzle in order to accomodate different thicknesses of sheet material being worked by the apparatus. For this purpose, each of the rock shafts 119 has a dog 125 rigidly affixed to its outer end to be pivoted as a result of rotation of the rock shaft. The support block 117 has a stop plate 126 secured to one marginal edge thereof in position to overlie the pair of dogs 125. As is best seen in FIG. 6, the stop plate 126 is provided with a longitudinally spaced pair of adjusting screws 127 threadedly mounted in tapped bores of the stop plate 126 for engagement of their lower ends with the free ends of the pair of dogs 125. Accordingly, referring now to FIG. 6, it will be seen that the dogs 125 and, therefore, the free forward ends of the support shoes 120 are positively limited against counterclockwise rotation to a degree dependent upon the adjustment of the screws 127. In order to bias each of the dogs against its associated stop a tensioned coil spring 129 is interconnected between the rock shafts 119 as indicated in FIG. 2. By this means, the gap between each of the applicator nozzles and its associated support shoe 120 can be adjusted to the thickness of the board or sheet material being processed.

For guiding the leading edge of a box blank into the gap between the support shoes 120 and the dispenser nozzles, the bracket assembly also mounts an elongate deflection shoe 130 whose overall configuration is best seen in FIGS. 4 and 6. The deflection shoe may conveniently be made from a length of strap metal bent to the profile shown in FIG. 6. In order to mount the deflection shoe to the bracket assembly the head of a bolt 131 is welded or otherwise secured thereto adjacent the forward end of the shoe, as is shown in FIG. 2. Referring to FIG. 4, the threaded shank of the bolt 131 extends through a sleeve 132 and through an opening in the upstanding flange 95 of the angle member 89. A nut 133 threadedly engages the outer end of the bolt 131 by means of which the deflection shoe 130 can be clamped in a desired adjusted position. Thus, referring to FIG. 2, if it is desired to adjust the forward free end of the deflection shoe 130 vertically the nut 133 can be loosened to pivotally adjust the shoe to the desired position, after which the nut can be resecured.

From the foregoing it will be seen that the invention provides a multi-dispenser body and automatic dispenser assemblies which can be assembled to serve as either a left or right-hand dispenser assembly. Accordingly, the need for manufacturing and maintaining inventories of different left and right-hand parts is obviated. The invention also provides a multi-dispenser assembly which can very easily be adjusted to define a desired lateral spacing between adjacent beads of glue to be deposited by the dispensers on box blanks or the like. Thus, referring to FIG. 1 the right-hand dispenser assembly 21 is illustrated with the body 24 substantially in line with the direction of travel of the box blanks 12 through the apparatus. Substantially the same adjustment is shown in FIG. 4 which also illustrates the resulting spacing between an adjacent pair of beads of glue 135 deposited on the upper surface of the box blank 12. If it is desired to increase the gap between beads of glue the dispenser assembly may be adjusted angularly relative to the direction of flow of the box blanks 12. Thus, the left hand dispenser assembly 23 of FIG. 1 is illustrated with its body 24 supported by bracket assembly 22 as angularly offset relative to the direction of flow of the box blanks. This results in an increased spacing between the dispenser nozzles. Conversely, if it is desired to narrow the spacing between deposited beads of glue the dispenser assembly shown in FIG. 4, for example, may be angularly adjusted in a clockwise direction from the position shown.

As has been noted, the pivot axis 36 of the actuator barrel of each dispenser assembly should be oriented parallel to the plane of the box blanks traveling through the apparatus and at 90° to the direction of movement of the box blanks. Accordingly, when a dispenser body 24 is adjusted to an angularly related position relative to the direction of flow of the work the actuator retainer 33 of each dispenser assembly should be angularly adjusted relative to the body 24 to return pivot axis 36 to the desired 90° orientation. This can very readily be accomplished merely be loosening the nut for the fastener means 103 whereby the entire dispenser assembly may be pivotally inverted about the axis of the pivot fastener 101. The indicator marks 40 of each actuator retainer 33 can then be viewed and a wrench applied to the wrench flats of the actuator retainer to turn it into the desired 90° position after which the assembly may be returned to and locked in the operative position. Thereafter, should it be necessary to adjust the flow rate of glue through the outlet orifices of the dispenser assemblies, the flow adjusting plugs 32 may be turned.

Referring to FIG. 2, it will be seen that when a box blank is driven into the gap between the deflection shoe 130 and the pair of support shoes 120 that the leading edge of the blank successively engages the nozzles of the actuator barrels of the two dispenser assemblies. As a result, each barrel is deflected through the arc indicated for the left hand dispenser assembly 25 effecting opening of the outlet orifice to deliver a stream of glue deposited as a bead on the upper surface of the box blank. Accordingly, each of the dispenser assemblies delivers glue onto a surface of the box blank substantially simultaneously with engagement of the leading edge of the box blank with the nozzle of a dispenser assembly.

On the other hand, and especially with hot glues, it is desirable to close the valve of each dispenser assembly prior to the moment at which the nozzle thereof leaves the trailing edge portion of the box blank. Such an arrangement insures that excess glue is not delivered through the outlet nozzle in the interval between box blanks and, in addition, provides a period in which the dispenser valve is closed while the nozzle thereof is wiped clean by the trailing edge portion of the box blank. This is accomplished by the longitudinal spacing between the free forward end of each support shoe 120 and its associated dispenser nozzle. Thus, as shown in FIG. 2*a*, upon the trailing edge of the box blank 12 leaving the forward end of a support shoe 120 the outlet valve of the dispenser nozzle associated therewith returns to closed position, slightly deflecting the free, trailing end portion of the box blank whereby the nozzle orifice 42 is wiped clean of excess glue during the term of the passage of the marginal trailing end portion of the box blank. I have discovered that this arrangement is very effective in insuring closing of the outlet nozzles of each dispenser fully, in the intervals between box blanks, and in wiping out of the orifice 42 of each nozzle substantially all of the excess glue downstream of the valve seat 43 by the surface of the trailing edge portion of the box blank.

While a specific embodiment of the invention has been described and illustrated it is intended to be purely illustrative and not limitative of the invention.

I claim:

1. A multiple fluid dispenser assembly comprising:

a dispenser body;

a plurality of fluid dispensers mounted in said body and having outlet nozzles protruding from the same face of said body terminating in substantially a common plane;

means for supporting said body and said dispensers for engagement of said nozzles with one surface of a sheet material to be passed adjacent said face of said body through a predetermined plane in a predetermined direction of travel;

means for adjusting said body angularly relative to the predetermined direction of travel of the sheet material for adjusting the spacing between said nozzles in a direction normal to said predetermined direction for correspondingly adjusting the lateral spacing between fluids deposited on the one surface of the sheet material by said nozzles of said dispensers;

each of said dispensers including an actuator barrel having said nozzle on the free end thereof, each of said actuator barrel being pivotally mounted in a retainer in said body for movement about a signel axis;

said retainer having means for angular adjustment of said retainer relative to said body for adjusting said pivot axis angularly with respect to said predetermined direction to dispose said pivot axis at substantially 90° to said predetermined direction in substantially all angularly adjusted positions of said body.

2. A dispenser assembly as in claim 1 in which said retainer bears an external indicator of the direction of said pivot axis, said body having mounting means to be invertible with respect to said first mentioned means to expose said retainer for angular adjustment of said pivot axis by reference to said external indicator.

3. A multiple dispenser assembly for applying fluid under pressure to one surface of a sheet material passing in a predetermined direction of travel through a predetermined plane in a sheet handling machine comprising:

a dispenser body;

at least two fluid dispensers mounted in said body, each dispenser having a nozzle protruding beyond the exterior of said body;

a bracket assembly for interconnecting said body to one side of a sheet handling machine in a position in which said nozzles normally intersect the predetermined plane to be engageable with one side of the sheet material;

at least two support shoes carried by said bracket assembly in a position to engage the other side of the sheet material to constrain the sheet material to the predetermined plane to deflect said nozzles, each of said shoes being in longitudinal alignment with one of said nozzles, each of said support shoes being carried on a rockable shaft and said bracket assembly having stop means to unidirectionally positively limit rocking of each of said shafts to correspondingly limit movement of the corresponding one of said shoes in a direction normal to the predetermined plane and away from the corresponding one of said nozzles;

said nozzles being movably mounted in said body for yieldable deflection of said nozzles relative to said body by the leading edge of a sheet material moving in the predetermined direction.

4. A dispenser assembly as in claim 3 in which said bracket assembly has means for angular adjustment relative to the predetermined direction of travel of the sheet material to adjust the lateral spacing between said nozzles and, correspondingly, between said support shoes, in a direction normal to the predetermined direction of travel.

5. A dispenser assembly as in claim 4 in which:

each of said dispensers includes an actuator barrel having said nozzle on the free end thereof;

said actuator being mounted in a retainer in said body for pivotal movement about a single axis;

said retainer having means for angular adjustment relative to said body for adjusting said pivot axis angularly with respect to said predetermined direction to dispose said pivot axis at substantially 90° to said predetermined direction in substantially all angularly adjusted positions of said body.

6. A dispenser assembly as in claim 3 in which said body mounts said dispensers in parallel through bores formed in said body, each of said dispensers comprising an assembly of elements including one of said nozzles that is reversely mountable within a bore of said body.

7. A dispenser assembly as in claim 6 in which said body comprises an oblique prism that is symmetrical about three mutually perpendicular axes with said bores of said body being parallel to the oblique axis of the prismatic body.

* * * * *

UNITED STATES PATENT OFFICE

CERTIFICATE OF CORRECTION

PATENT NO. : 3,994,256

DATED : November 30, 1976

INVENTOR(S) : Lenard E. Moen

It is certified that error appears in the above-identified patent and that said Letters Patent are hereby corrected as shown below:

Column 4, line 62, change "bore" second occurrence ---bores---.

Column 9, line 22, change "barrel" to --barrels--.

line 24, change "signel" to --single--.

Signed and Sealed this

Fifteenth Day of February 1977

[SEAL]

*Attest:*

RUTH C. MASON
*Attesting Officer*

C. MARSHALL DANN
*Commissioner of Patents and Trademarks*